US009062841B2

(12) United States Patent
Tran et al.

(10) Patent No.: US 9,062,841 B2
(45) Date of Patent: Jun. 23, 2015

(54) TWO-DIMENSION CONFIGURABLE LIGHTING SYSTEM WITH ENHANCED LIGHT SOURCE PLACEMENT CAPABILITIES

(71) Applicant: ABL IP Holding, LLC, Conyers, GA (US)

(72) Inventors: Michael Trung Tran, Oakland, CA (US); Darren Blum, San Mateo, CA (US); Peter Y. Y. Ngai, Alamo, CA (US); Min-Hao Michael Lu, Castro Valley, CA (US); Jeannine Fisher Wang, Oakland, CA (US); Aaron Mathew Engel-Hall, San Francisco, CA (US)

(73) Assignee: ABL IP Holding, LLC, Conyers, GA (US)

( * ) Notice: Subject to any disclaimer, the term of this patent is extended or adjusted under 35 U.S.C. 154(b) by 137 days.

(21) Appl. No.: 13/888,311

(22) Filed: May 6, 2013

(65) Prior Publication Data

US 2013/0294079 A1 Nov. 7, 2013

Related U.S. Application Data

(60) Provisional application No. 61/643,089, filed on May 4, 2012.

(51) Int. Cl.

| | |
|---|---|
| ***F21S 4/00*** | (2006.01) |
| ***F21V 21/00*** | (2006.01) |
| ***F21S 8/04*** | (2006.01) |
| *F21S 2/00* | (2006.01) |
| *F21Y 101/02* | (2006.01) |
| *F21Y 105/00* | (2006.01) |

(52) U.S. Cl.

CPC .. *F21S 8/043* (2013.01); *F21S 8/04* (2013.01); *F21S 2/005* (2013.01); *F21Y 2101/02* (2013.01); *F21Y 2105/008* (2013.01); *F21S 8/046* (2013.01)

(58) Field of Classification Search

CPC ..... F21S 8/04; F21S 8/046; F21S 8/043; F21S 2/005; F21Y 2101/02; F21Y 2105/008; F21Y 2105/00; F21Y 2105/001; F21Y 2105/006

USPC ..... 362/249.15, 227, 249.14, 249.06, 370; 40/544

See application file for complete search history.

(56) References Cited

U.S. PATENT DOCUMENTS

| | | | | |
|---|---|---|---|---|
| 3,786,246 | A * | 1/1974 | Johnson et al. | 446/47 |
| 4,244,013 | A * | 1/1981 | Wotowiec | 362/216 |
| 8,454,197 | B2 * | 6/2013 | Hauschulte et al. | 362/249.03 |
| 2003/0230331 | A1 * | 12/2003 | Li | 135/910 |

(Continued)

OTHER PUBLICATIONS

Halla, A.S., MILA Luminaire, seen on Halla, A.S. website at http://www.halla.eu/mila and http://www.halla.eu/f/a/62/halla_svetlo2_13cz.jpg, downloaded by undersigned Feb. 16, 2015, publicly disclosed circa Mar. 2012.

*Primary Examiner* — Anh Mai
*Assistant Examiner* — Glenn Zimmerman
(74) *Attorney, Agent, or Firm* — Beeson Skinner Beverly, LLP

(57) ABSTRACT

A lighting system having neural hubs that connect to other neural hubs in a manner that allows a lighting system to be configured in a two dimensional pattern that can propagate out from a single neural hub. Straight sections can be provided for use in connection with the neural hubs to enhance the configurability of the lighting system.

28 Claims, 8 Drawing Sheets

(56) References Cited

U.S. PATENT DOCUMENTS

| | | | | |
|---|---|---|---|---|
| 2008/0244944 | A1* | 10/2008 | Nall et al. | 40/544 |
| 2009/0196034 | A1* | 8/2009 | Gherardini et al. | 362/235 |
| 2010/0210918 | A1* | 8/2010 | Dunn et al. | 600/249 |
| 2010/0328943 | A1* | 12/2010 | Takamura et al. | 362/235 |
| 2011/0134637 | A1* | 6/2011 | Lin et al. | 362/235 |
| 2011/0175533 | A1* | 7/2011 | Holman et al. | 315/130 |
| 2011/0175545 | A1* | 7/2011 | Harris | 315/294 |
| 2012/0294016 | A1* | 11/2012 | Tran et al. | 362/382 |
| 2012/0300437 | A1* | 11/2012 | Lu et al. | 362/147 |

* cited by examiner

TWO-DIMENSION CONFIGURABLE LIGHTING SYSTEM WITH ENHANCED LIGHT SOURCE PLACEMENT CAPABILITIES

CROSS-REFERENCE TO RELATED APPLICATIONS

This application claims the benefit of U.S. Provisional Patent Application No. 61/643,089 filed May 4, 2012, which is incorporated herein by reference.

FIELD OF THE INVENTION

The present invention generally relates to lighting systems and more particularly to lighting systems that can be configured in a space.

Architectural lighting systems provide both a lighting function and an aesthetic function in the space to be illuminated. The challenge to the lighting designer is to deliver light where desired in the space while making the physical lighting fixtures used to deliver the light aesthetically pleasing. These challenges are commonly presented in office environments, including open offices, which have overhead grid ceilings. Lighting fixtures used in such architectural environments include recessed lighting and ceiling suspended lighting. Recessed lighting is relatively limited in how the light is delivered to the space and offers little in the way of aesthetic appeal. Conventional ceiling suspended lighting systems, such as linear fluorescent lighting, is generally more flexible in its light delivery capabilities and can be configured to create aesthetically pleasing architectural elements within a space. Nonetheless, existing ceiling suspended lighting systems still have limitations that limit the lighting designer's ability to create a configurable lighting system that delivers light within the space where it is most needed. Existing ceiling suspended lighting systems also tend to be limited to physical forms where the hardware, such as fixture housings, of the lighting system tend to dominate instead of the light emitting elements themselves.

The present invention is directed to a configurable lighting system that overcomes limitations presented by prior art lighting fixtures and systems and that expands the tools available to a lighting designer to create ceiling suspended lighting systems that are both aesthetically pleasing and capable of delivering light to precise locations within a space. The invention is particularly adapted for use in spaces having grid ceilings with defined spacings between suspension points within the grid framework of the ceiling, and can be adapted to present lighting elements to a space where the visual appearance of the lighting system is dominated by a pattern lights produced by the light emitting surfaces of the lighting elements.

SUMMARY OF INVENTION

The present invention involves a two dimensional lighting system having neural hubs that can be interconnected with or without additional straight elements in a manner that allows a lighting system to be configured in a pattern that can propagate out in a two dimensional plane from a single neural hub. A plurality of lighting elements can be connected to the neural hubs of the lighting system, as well as to any additional straight elements used to configure the lighting system, to form a neural pattern of lighting elements. Preferably, the lighting elements are planar form lighting elements such as OLED panels, which present a pattern of visually dominating light emitting surfaces to the observer of the lighting system. The propagated neural hub based lighting system produces both an aesthetically pleasing lighting environment and a two-dimensional lighting system that provides enhanced light placement capabilities. The system provides a wide range of design options for distributing light to different areas within a space and for achieving improved lighting application efficiencies.

The invention is uniquely be adapted for mounting below a grid ceiling system in a wide variety of configurations, including configurations involving the use of multiple neural hubs that propagate the system out in an extended pattern of lighting. In one aspect of the invention suspension, points for the system are provided at the neural hubs, which are located at the intersections of a hex pattern lighting system. With the neural hub suspensions, suspension point placements can be established that correspond to required suspension locations on a square or rectangular T-bar grid of a grid ceiling.

In another aspect of the invention, each neural hub can have a center section and three neural arms that radiate out from the center section. Each neural arm of the neural hub radiates from the hub's center section at an angle that preferably is 120 degrees from its adjacent arms. With this angular relationship between neural arms, an angular relationship of 120 degrees or multiples of 120 degrees can be maintained between the neural arms of multiple interconnected neural hubs and between any straight elements that may be connected to any neural arm of any neural hub. With the neural hubs in accordance with the invention, lighting patterns can be propagated out from a single neural hub in a neural hex pattern.

Each of the neural hubs can have lighting element connector rails to which the lighting elements of the system are connected and which provide wireways for wiring the light elements. The neural hubs can be joined together or to additional straight elements through these connector rails.

The neural hub preferably has three connector rails, each of which can have a curved mid-section and two straight terminal sections. The three connector rails preferably are substantially identical, with the curved mid-section of each rail having an arc of 120 degrees such that the straight terminal sections of each connector rail extend out 120 degrees relative to each other. A hanger bracket supports the three connector rails in a plane and holds the connector rails such that adjacent terminal sections of the rails extend radially outwardly from the center section of the hub in a spaced apart parallel relationship. These adjacent terminal sections form the backbone of the arms of the neural hub.

In addition to the neural hubs, the lighting system can include straight elements to expand the possible lighting configurations that can be created by a lighting designer. The straight elements can have parallel connector rails, which have a spacing that corresponds to the spacing of the adjacent straight terminal sections of the rails of the neural hubs that form the backbone of the neural arms of the hubs. This will allow the connector elements to be joined directly to the neural arms of the neural hubs.

The connector rails of the neural hubs and straight elements are preferably adapted to allow the lighting elements to be connected anywhere along the connector rails. The neural hex pattern formed by the rails of the hubs and straight elements can be populated with lighting elements that are evenly spaced along the rails or unevenly spaced or clustered on the rails to achieved desired light distributions. The light placement capabilities of the lighting system can be extended in multiple directions within a two dimensional plane by simply adding neural hubs and/or straight sections to the neural configuration of the lighting system.

DESCRIPTION OF ILLUSTRATED EMBODIMENT

Figure 1:
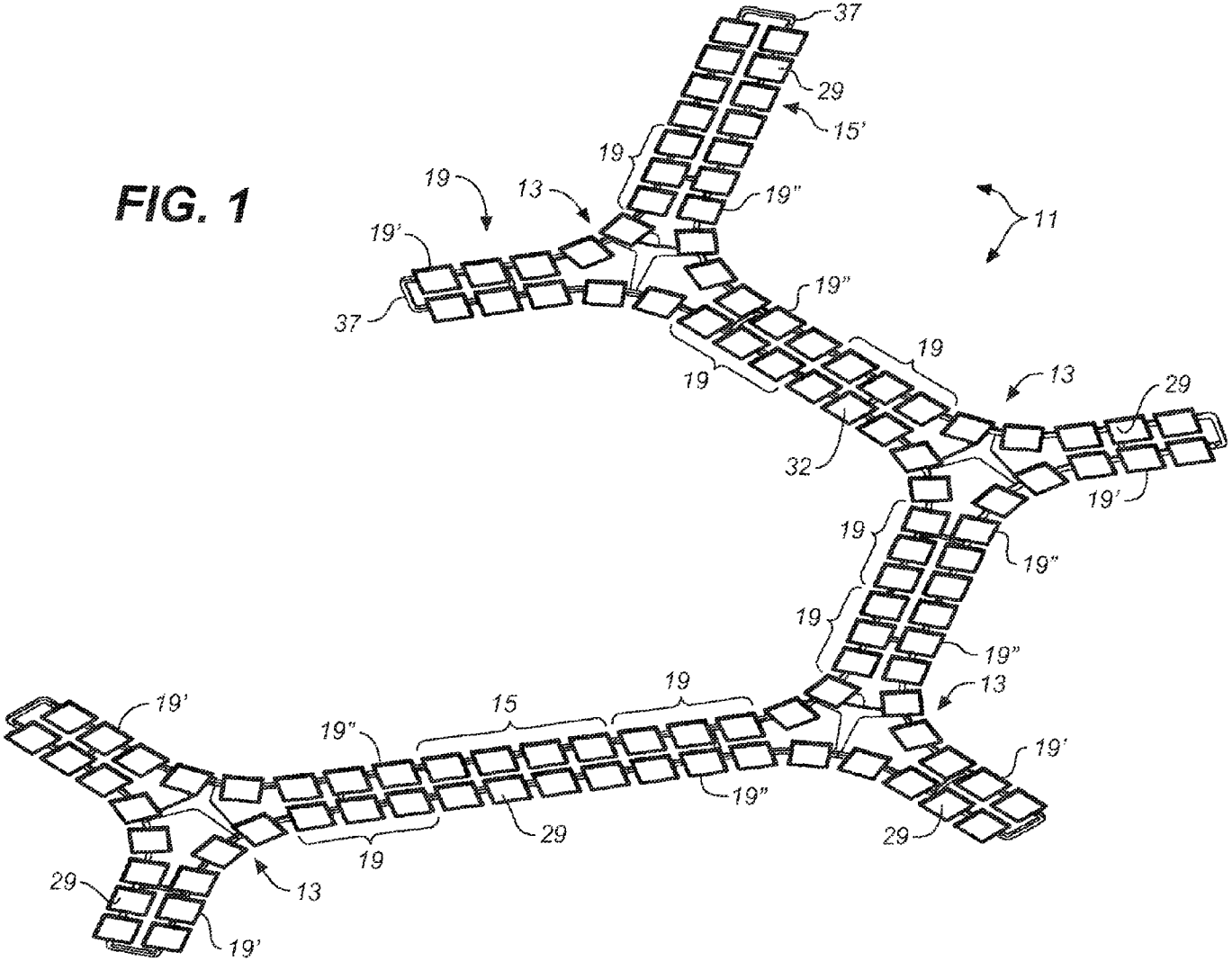
FIG. 1 is a bottom perspective view of a configurable two-dimension configurable light system in accordance with the invention, showing a system with multiple neural hubs and additional straight elements.

Referring to the drawings, FIG. 1 shows a configurable lighting system generally denoted by the numeral 11 comprised of neural hubs 13 and additional straight elements 15 that can connect to the neural hubs. Each neural hub has a center section 17 and three neural arms 19 radiating out from the center section. The neural arms have connector ends, such as further described below, and preferably radiate from the center of the neural hub out a sufficient distance to form straight neural arms capable of supporting lighting elements as hereinafter described. Each arm radiates from the center section at an angle that is 120 degrees from its adjacent arms so that all of the arms of the interconnected neural hubs and all straight elements connected to neural hubs have an angular relationship to each other of 120 degrees or multiples of 120 degrees. It can be seen that a configurable lighting system can be propagated out in multiple directions from a single neural hub in a two-dimensional pattern, herein referred to as a "neural hex pattern" or "hex pattern", characterized by the maintenance of a 120 degree relationship between the hub's straight neural arms and the additional straight elements of the system. The neural hex pattern provides an aesthetically pleasing lighting system as well as a lighting system that allows the lighting elements of the system to advantageously be configured within a space for satisfying a wide variety of lighting application needs.

The neural hex pattern of the lighting system has a further significant advantage where the lighting system is suspended under a conventional grid ceiling having two-by-two foot or two-by-four foot T-bar grids. As hereinafter described, the suspension points for the lighting system can be provided at the center of each neural hub of the lighting system. By placing the suspension points at the neural hub centers, it has been found that the neural hex pattern will allow the suspension point at each hub to be located on-center beneath desired suspension points on the grid ceiling, even with an extended hex pattern comprised of many neural hubs and straight elements.

With further reference to FIG. 1, it can be seen that the 120 degree arms 19 of each neural hub 13 can either be terminated to end the hex pattern propagation, as with terminated arms 19', or can be connected to the neural arms of another neural hub or to a straight element 15, as with arms denoted 19". Also, any straight element of the lighting system can be terminated rather than being connected to another neural hub, as with straight element denoted 15' in FIG. 1. As still further later described, a neural arm of a neural hub can be connected to the neural arm of another neural hub. Indeed, as hereinafter described in connection with FIG. 8, a wide range of neural hex patterns can be created using only neural hubs, provided the neural arms radiate out a sufficient distance from the center of the hub.

Figure 2:
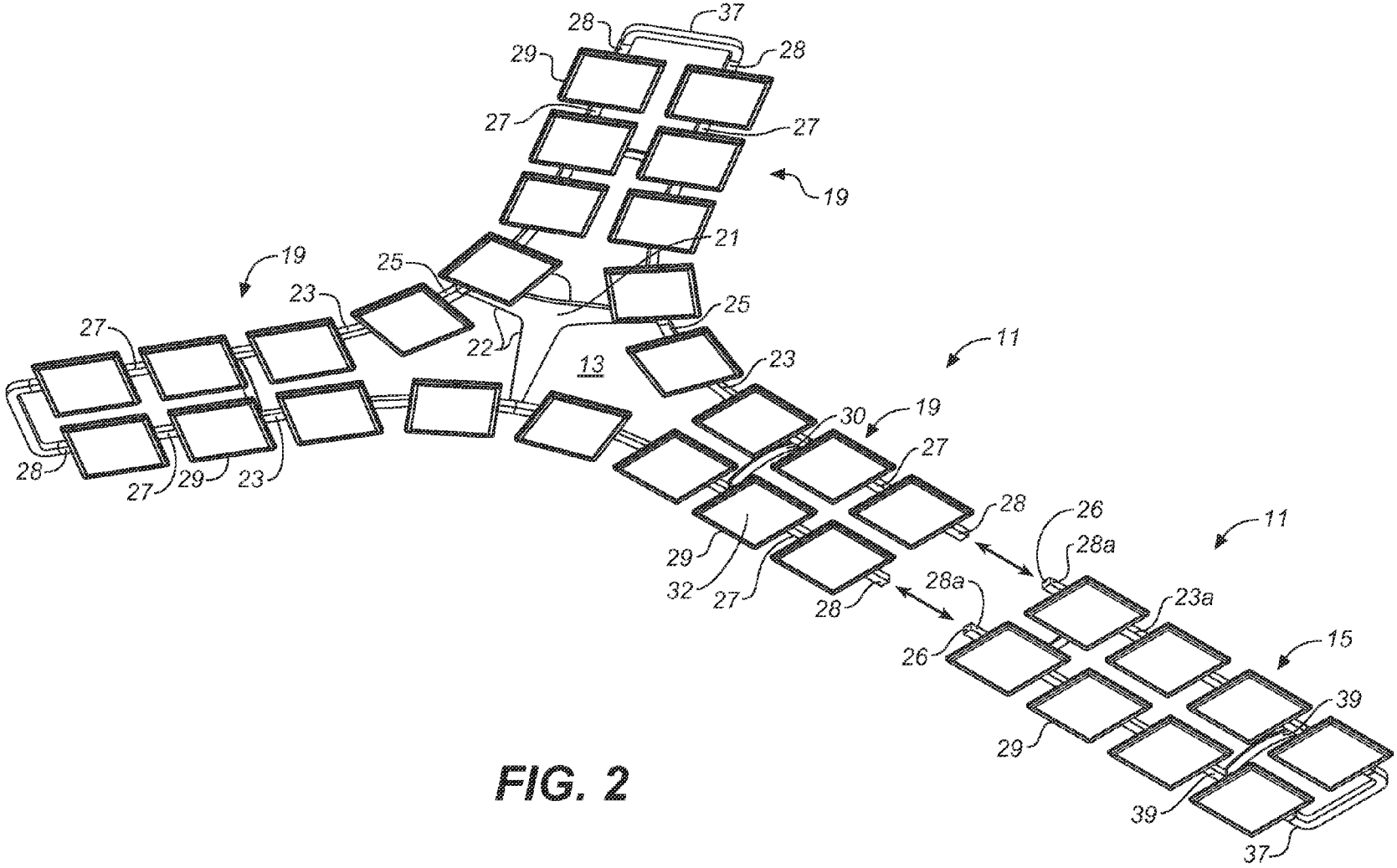
FIG. 2 is an enlarged partially exploded bottom perspective view of a configurable two-dimension configurable light system in accordance with the invention showing in greater detail a single neural hub with a single straight element attached to one neural arm of the neural hub.
Figure 3:
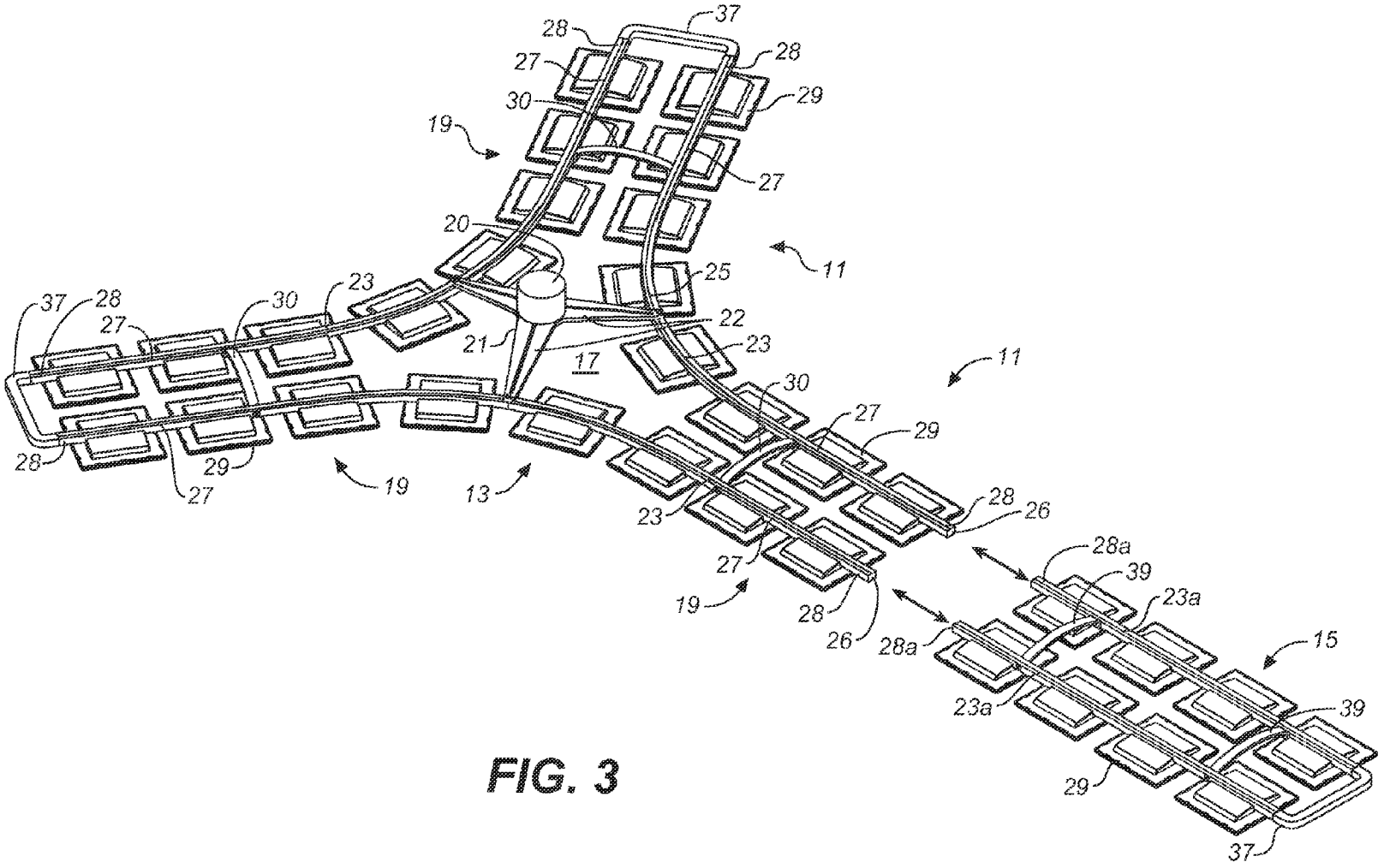
FIG. 3 is a top perspective view of the lighting system shown in FIG. 2.
Figure 4:
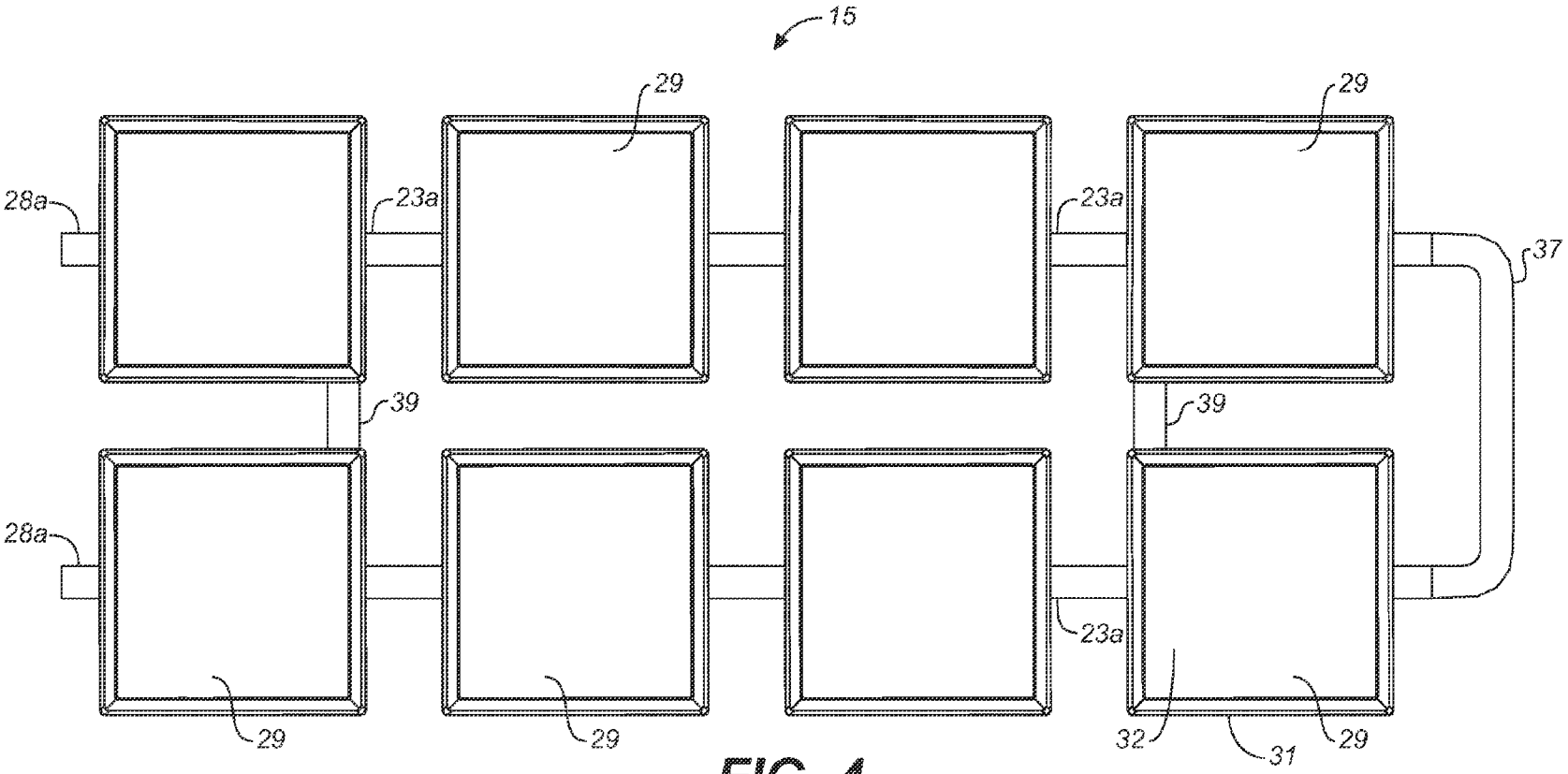
FIG. 4 is an enlarged top plan view of the straight element of the lighting system shown in FIG. 2.

FIGS. 2-3 show in more detail the illustrated embodiment of the unique neural hub of the invention and how the lighting elements are mounted to and configured on the neural hub. Referring to these figures, neural hub 13 is seen to include a center hanger bracket 21 and three connector rails 23, each having a curved mid-section 25 and two straight terminal sections 27 with connector ends 28. The center hanger bracket 21 can have a center core 20 and spokes 22 radiating out from the center core, which suitably radiate out at 120 degree angles relative to each other. The connector rails are substantially identical with the curved mid-sections having an arc of 120 degrees such that the straight terminal sections of each connector rail extend out 120 degrees relative to each other.

The hanger bracket supports the three connector rails in a plane. Specifically, the spokes of the hanger bracket connect to and hold the connector rails at the mid-point of each of the rail's curved mid-section 25 such that the rails' terminal sections 27 extend radially outwardly from the center of the hub, and such that the terminal section of one rail extends in a close parallel relationship to the terminal section of the adjacent rail. Each of the paired terminal sections of the three rails provide the backbone for one the radiating neural arms of the neural hub, and can be structurally strengthened and maintained in parallel relation by suitable cross-bracing structures, such as by bridge brackets 30. It is seen that the connector ends 28 of the adjacent pairs of terminal sections of the connector rails form the connector ends of the neural arms of the neural hub.

The connector end of each to the hub's neural arms 19 is suitably provided with means for connecting the end of any one of the neural arms of the neural hub to the end of any one of the neural arms of another neural hub or to an end of a straight element 15. This end-to-end connection capability can be provided by any suitable means, such as by providing alternating male and female end configurations to the connector ends 28 of the hub's three connector rails 23 wherein connector ends of the paired rails of a neural arm of one neural hub of can slide into the connector ends of the paired rails of a neural arm of another neural hub and be secured in place, such as by set screws (not shown).

Figure 5:
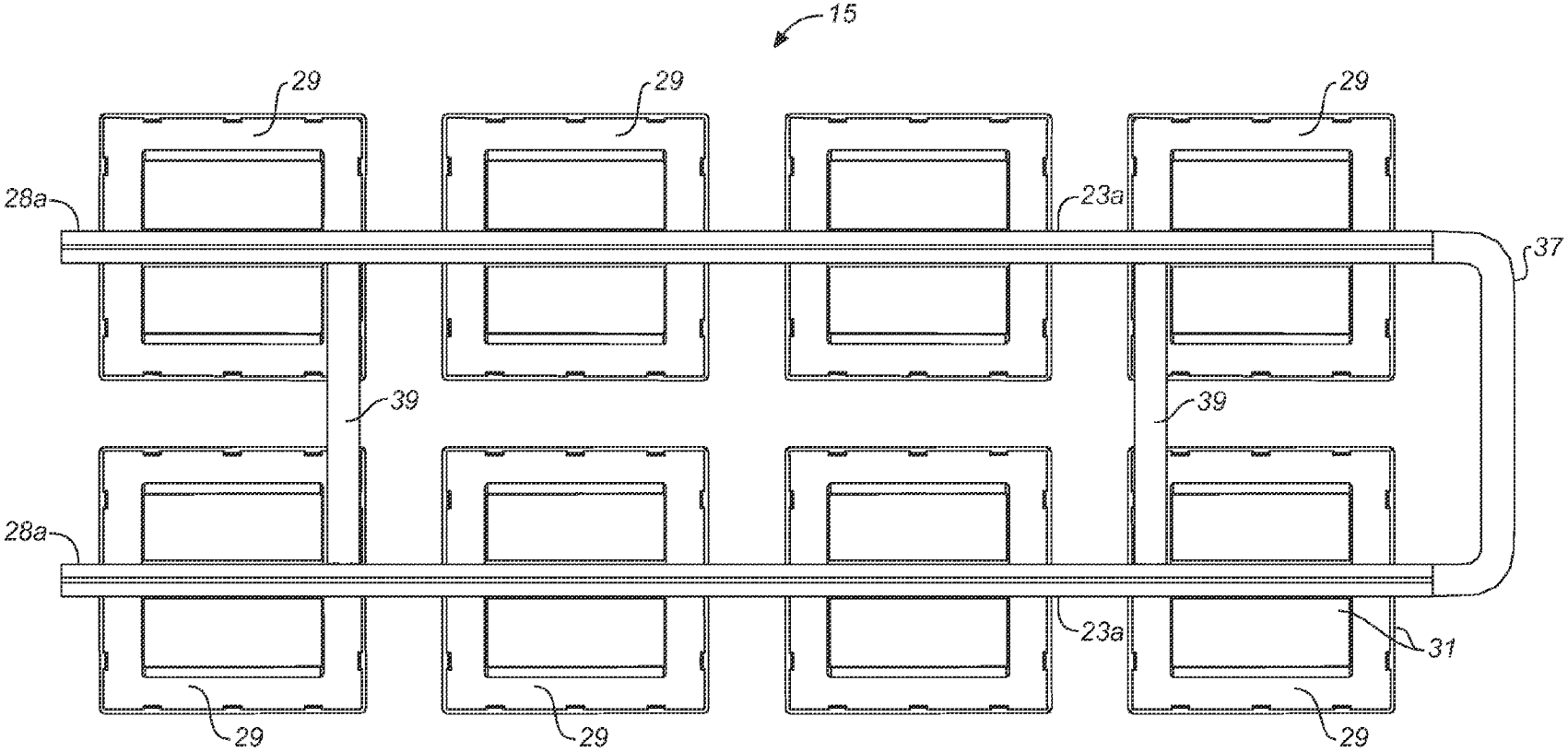
FIG. 5 is a top plan view thereof.
Figure 6:
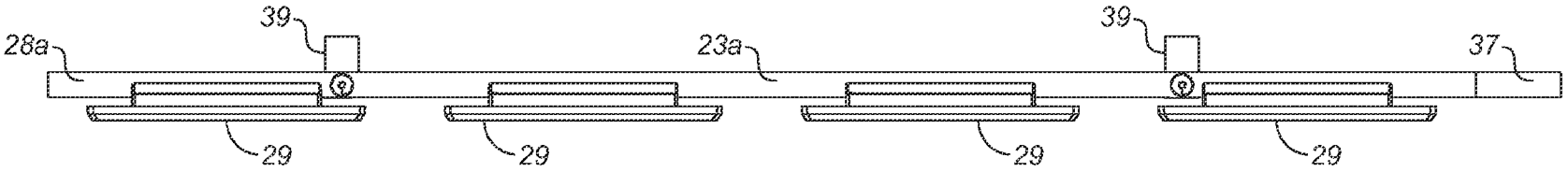
FIG. 6 is a side elevational view of the straight element shown in FIGS. 4 and 5.
Figure 7:
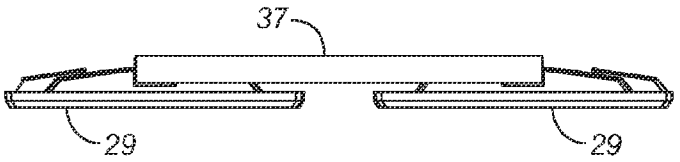
FIG. 7 is an end elevational view thereof.

Each of the hub's three connector rails provides wireways (denoted by the numeral 26 in FIGS. 2 and 3) for the electrical wiring or other suitable conductors for the lighting elements connected to the rails. In the illustrated embodiment the lighting elements are provided in the form of planar lighting element such OLEDs, which are denoted by the numeral 29, but they could be other types of lighting elements, such as LEDs. As best shown in FIGS. 5-7, the OLED panels can removably be held in a cassette 31, which in turn can be mounted to the rails anywhere along the length of the rails. The OLED cassettes 31 can generally be constructed as described in commonly owned and co-pending U.S. patent application Ser. No. 13/461,657 filed May 1, 2012, which is incorporated herein by reference.

Figure 5A:
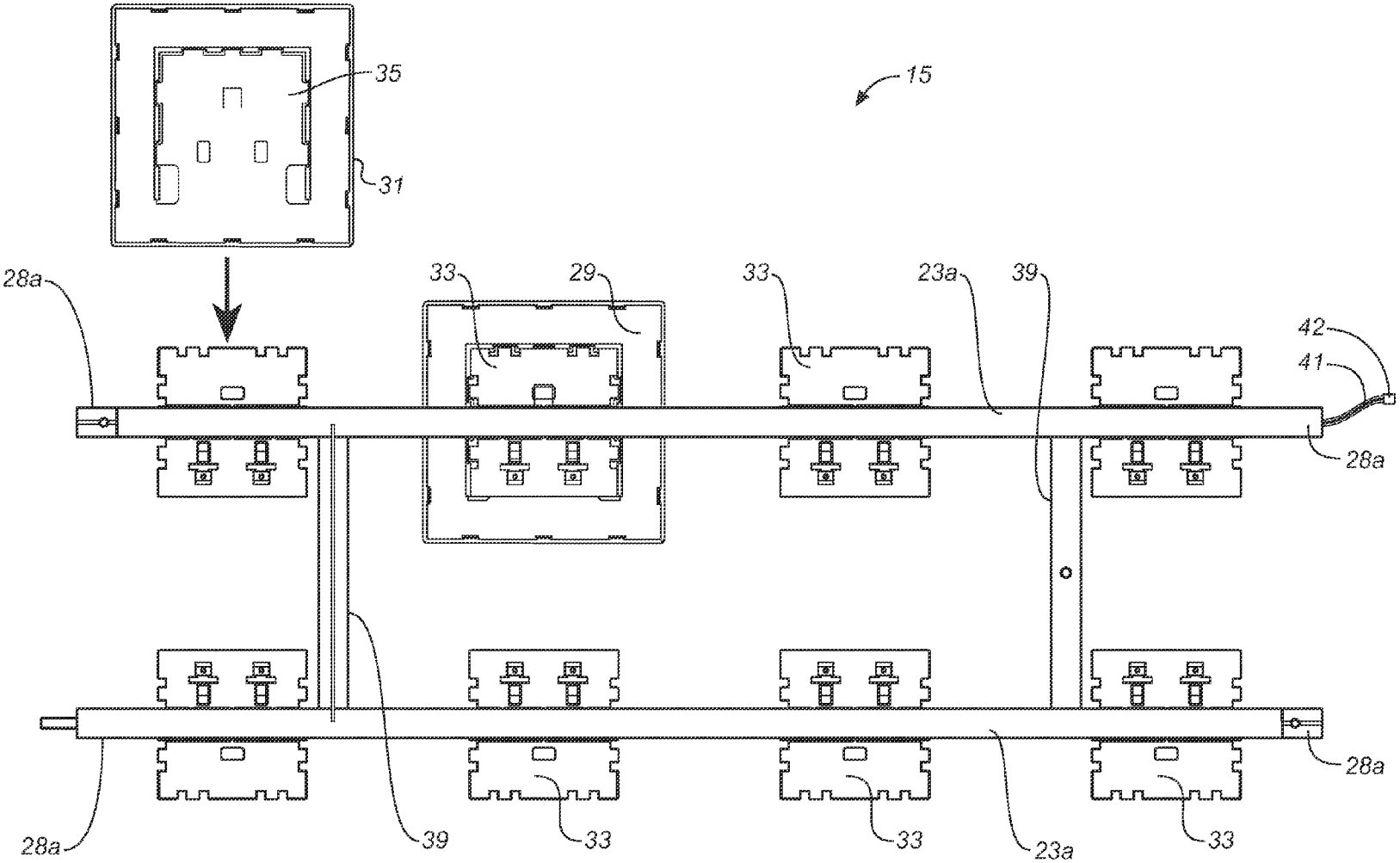
FIG. 5A is a top plan view of the straight element shown in FIGS. 4 and 5, but with some of the light panels removed from the adaptor plates used to attach the light panel to the connector rails of the straight element, and with the return rail removed.

Reference is now to FIG. 5A showing an exemplary structure for connecting OLED cassettes to a straight element 15 that can be used in configuring a lighting system in accordance with the invention. (Further aspects of the straight element is described in more detail below.) This same structure can be used for connecting OLED cassettes to the rails of the neural hubs. The connecting structure includes an adaptor plate 33 fastened to a rail. An OLED loaded cassette 31 can be attached to this adaptor plate by sliding the cassette onto the adaptor plate so that the adaptor plate is captured in the slide pocket 35 on the back of the cassette. The bottom of the rails can have suitable fastening means (not shown) for attaching the adaptor plate anywhere along the length of the rail and can additionally have means for electrifying the OLED panel through the adaptor plate. For example, the adaptor can have a longitudinal slot in its bottom side through which a fastener for the adaptor plate, such as a screw fastener, can be lockingly inserted, and through which an electrical connection path can be provided to the OLED panel loaded in the cassette.

It can be seen that the connector rails 23 of the hub provide a continuous unbroken path from one neural arm of the hub to the hub's next neural arm. The curved mid-section of the rails causes this continuous path to sweep through the hub's center section 17. As mentioned above, lighting elements, such as OLED panels 29, can be operatively connected to any one of the rails of the hub, and anywhere along the path of any rail. Thus, the neural hubs of the lighting system can be populated with lighting elements in any desired distribution. They can be evenly spaced as illustrated in the drawings or they can be unevenly spaced or clustered in groups of elements anywhere on the rails. If connected to the rails with a relatively close spacing between the OLED panels as shown in the drawings, that planar light emitting surfaces 32 of the OLED panels 29 will dominate the visual appearance of the lighting system and substantially hide the underlying structural elements of the hub. Indeed, when illuminated, substantially the only thing visible to the observer will be the pattern of illuminated OLED panels.

FIGS. 4-7 show an example of a straight element 15 for use in the lighting system. The straight element illustrated in these figures is comprised of a pair of connector rails 23*a* having connector ends 28*a*. Connector rails 23*a* are held together in parallel relation by bridge brackets 39 similar to the illustrated bridge brackets 30 used to hold together the connector rails of the neural hub. Preferably, the spacing of the rails 23*a* of the straight element will correspond to the spacing of the rails 23 at the straight terminal sections 27 of the arms of neural hubs 13; this will allow the connector ends 28*a* of the rails of the straight element to be connected directly to any one of the terminal sections of the arms of a neural hub without any sort of alignment adaptor. If the opposite end of the straight element is not connected to another neural hub (or another straight element), then this becomes a free end that can be terminated by a return rail, such as U-shaped return rail 37. As is seen in FIG. 1 with respect to free hub arms 19*a*, a similar return rail can be used to terminate any of the paired terminal sections of the neural hub connector rails forming the backbone of the hub's neural arms. The return rail provides an aesthetically pleasing termination of the free ends of the hub arms or straight elements. It also provides a return path or wireway for the electrical wires or other conductors in the connector rails.

The connector ends 28*a* of the connector rails of the straight element 15 can be adapted to connect to the connector ends 28 of the connector rails of the neural hub in the same fashion that the connector end of a neural arm of one neural hub is connected to the arm of another neural hub as above described. Suitably, all connections between all parts of the system are made in the same manner throughout the system.

The lighting system described and illustrated herein can be configured around the neural hubs or a combination of neural hubs and straight elements to span, in a neural hex pattern, as much of a ceiling as necessary to meet a lighting designer's lighting application needs. The lighting application will determine the spacing between the lighting elements along the rails. For example, at locations where more light is required, the lighting elements can be closely spaced to increase the amount of light at that location; at locations where less light is required, the lighting elements can be spaced further apart or eliminated altogether. Preferably, the lighting elements can be connected to the rails anywhere in the hex pattern above the space, including on the neural hubs. The confluence of the connector rails at the neural hubs provides an opportunity to bring a concentrated amount of light to the space beneath the neural hub locations. The ability to strategically place the neural hubs can increase the options of the lighting designer for meeting his or her lighting application needs.

Also, as above-indicated, when the planar lighting elements such as OLEDs are used, the lighting elements will dominate the visual appearance of the lighting system. This is particular true when the lights are turned on. When turned on, what the observer will see is an aesthetically attractive pattern of seemingly floating light emitting surfaces below the ceiling.

Figure 8:
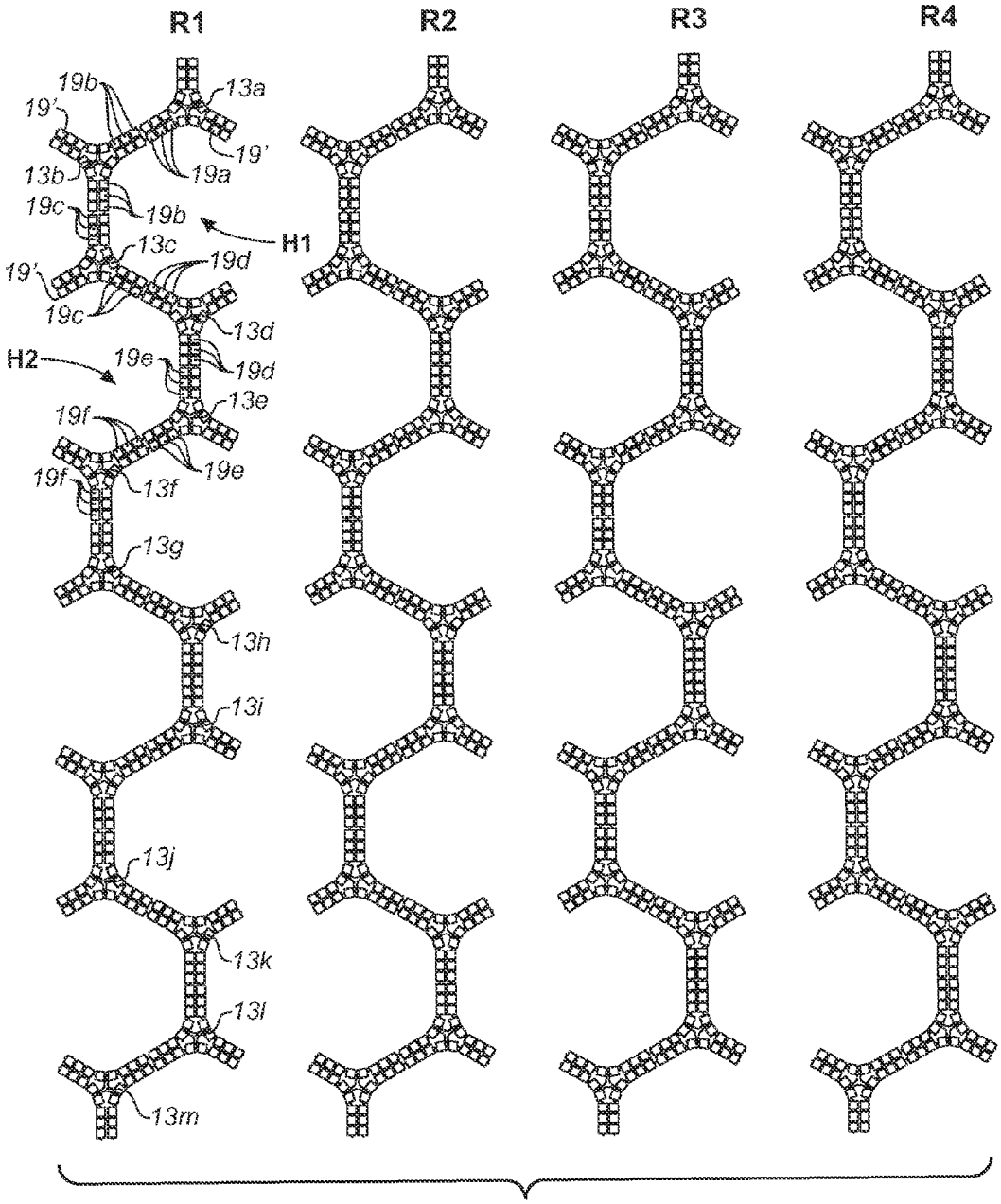
FIG. 8 is a bottom plan view of a configurable two-dimension configurable light system in accordance with the invention, showing an exemplary design for a system having rows multiple connected neural hubs.

FIG. 8 illustrates just one example of a complex hex pattern configuration that can be created with a configurable lighting system in accordance with the invention. The configured lighting system illustrated in FIG. 8 consists only of neural hubs such as shown in FIGS. 2 and 3. The configuration consists of neural hubs that are interconnected to propagate in hex pattern rows, denoted R1, R2, R3 and R4, consisting of sequential partial hexagons. Each hex pattern row is created by connecting one of the neural arms 19 of one neural hub 13 to one arm of another neural hub and leaving the other two neural arms 19' of the neural hub as free arms. (A return rail, such as return rail 37 described above, can be connected at the ends of the free arms 19' of each neural hub.) For instance, the first partial hexagonal shape denoted H1 in row R1 is created using four neural hubs 13*a*, 13*b*, 13*c*, 13*d* connected one to the other via neural arms 19*a*-19*b*, 19*b*-19*c*, and 19*c*-19*d*. The neural hubs 13*c* and 13*d* then form one half of the next partial hexagonal shape H2, which is reversed in direction from partial hexagon H1. The reversed partial hexagon H2 consists of neural hubs 13*c*, 13*d*, 13*e* and 13*f* connected one to the other via single neural arms 19*c*-19*d*, 19*d*-19*e* and 19*e*-19*f*. These connections are simply repeated to create each row of elongated hex patterns.

Any or all of the individual partial hexagons of the above-described neural hex pattern row could be stretched in length by adding a straight element, such as straight element 15 described above, between the arms of the neural hubs extending in the direction of the row, such as between connection 19*b*-19*c* and 19*d*-19*e*. Any or all of the neural hubs in each row can be selected as suspension points for the hex patterned rows of neural hubs. The extended hex patterns shown in FIG.

8 could, for example, be advantageously suspended below a grid ceiling of a large open office.

It is contemplated that installable sections of a configurable lighting system in accordance with the invention can be preassembled off-site, such as by the manufacturer, in accordance with a lighting configuration created for a particular space by a lighting designer. The preassembled sections could then be shipped to the project site and assembled and suspended by suspension cables dropped from the ceiling, such as a grid ceiling, at the predetermined suspension points, which would correspond to neural hubs hub locations. Power cords can be dropped from the ceiling at selected suspension points with the wires from the power cord being run through the center hanger bracket 21 of the correspondingly sited neural hub. Wires from the power cord can then connected to the wires (or conductors) in the wireways of the neural hub's connector rails 23. The ends of the wires emerging from hanger brackets and joinable ends of the connector rails of the system can suitably by provided with quick connectors (such illustrated by element 42 in FIG. 5A) for ease of connecting up the wires of the system.

While the present in invention has been described in some detail in the foregoing specification and the accompanying drawings, it is not intended that the invention be limited to such detail unless otherwise indicated herein. It will be appreciated that variations of the illustrated embodiments would be readily apparent to persons skilled in the art. For example, the neural arms and center section of the above-described neural hubs could separate parts where the neural arms are attachable to the center section. And the neural arms of a neural hub could be of different lengths or shorter or longer than shown. Still further each of the connector rails 23 of the neural hub and/or the connector rails 23*a* of the straight element could be an unitary rail of a rail made up of joinable sections of shorter rail segments.

What we claim is:

1. A two-dimension configurable lighting system comprising at least two neural hubs, each of said neural hubs having a center section and neural arms radiating out from said center section, said neural arms having connector ends, and a plurality of lighting elements connected to the center section and neural arms of said neural hub to form a pattern of lighting elements thereon, the neural arm of any one of said neural hubs being connectable to any one of the neural arms to the other neural hub at the connector ends thereof.

2. The two-dimension configurable lighting system of claim 1 wherein said neural hub has three neural arms radiating from said center section 120 degrees apart.

3. The two-dimension configurable lighting system of claim 1 wherein the center section of each neural hub provides a suspension point for suspending said lighting system from an overhead ceiling structure.

4. The two-dimension configurable lighting system of claim 1 further comprising a plurality of straight elements having connector ends which are connectable to the connector ends of any one of the neural arms of said neural hub.

5. The two-dimension configurable lighting system of claim 1 wherein each of said neural hubs is comprised of:

a plurality of connector rails, each of said connector rails having a curved midsection transitioning into straight terminal sections, said connector rails being interconnected such that the curved midsection of the rails form the center section of the neural hub and the straight terminal sections of adjacent connector rails radiate out from the center section in pairs that form the neural arms of said neural hub, the straight terminal sections of the connector rails having connector ends wherein the connector ends of the pairs of straight sections that form the neural arms of the neural hub form the connector ends of the neural arms, said plurality of lighting elements being connectable to any one of said connector rails anywhere along the length thereof.

6. The two-dimension configurable lighting system of claim 5 wherein said neural hub is comprised of three substantially identical connector rails, each having a curved midsection sweeping through an arc of 120 degrees such that the straight terminal sections of adjacent connector rail extend out 120 degrees relative to each other to form the neural arms of said neural hub.

7. The two-dimension configurable lighting system of claim 5 wherein said neural hub further includes a center hanger bracket having a center core and spokes radiating out from the center core, each of said spokes supporting one of the connector rails of the neural hub, said center hanger bracket providing a suspension point for said lighting system.

8. The two-dimension configurable lighting system of claim 5 wherein said neural hub further includes a bridge bracket connected between the adjacent straight terminal sections of each pair of the connector rail's straight termination sections that form the neural arms of the neural hub.

9. The two-dimension configurable lighting system of claim 5 wherein the connector rails of said neural hub provide wireways for the wiring the lighting system.

10. The two-dimension configurable lighting system of claim 9 further comprising return rails connectable to the connector ends of the pairs of straight sections that form the neural arms of the neural hub to provide and return path for the wireways in said connector rails.

11. A two-dimension configurable lighting system comprising a plurality of neural hubs, each of said neural hubs having a center section and three neural arms radiating out from said center section, said neural arms being separated by 120 degrees and having connector ends adapted to be connected to any one of the neural arms of another of the plurality of said neural hubs, and a plurality of lighting elements connected to the center section and neural arms of each neural hub to form a pattern of lighting elements thereon which extends through the center section and into the neural arms of the neural hub.

12. The two-dimension configurable lighting system of claim 11 wherein said plurality of lighting elements form a continuous pattern of lighting elements extending through the center section of the neural hubs and into the neural arms of the neural hub for substantially the entire length to the neural arms, such that, when the connector arm of one neural hub is connected to the neural arm of another neural hub, a continuous pattern of lighting elements is produced across the connected neural arms of the connected neural hubs to form a neural hex pattern of lighting elements.

13. The two-dimension configurable lighting system of claim 11 further comprising at least one straight element having connector ends which are connectable to the connector ends of any one of the neural arms of said neural hub, said straight element having a plurality of lighting elements connected in a continuous pattern of lighting elements for substantially the length of the straight element, such that, when the connector end of the straight element is connected to a neural arm of a neural hub, a continuous pattern of lighting elements is produced across the connected straight element and neural hub.

14. The two-dimension configurable lighting system of claim 11 wherein the center section of each neural hub provides a suspension point for suspending said lighting system from an overhead ceiling structure.

15. The two-dimension configurable lighting system of claim 11 wherein the plurality of lighting elements for each neural hub are planar lighting elements having planar light emitting surfaces and wherein the neural hub presents a pattern of continuous planar light emitting surfaces which extends through the center section and into the neural arms of the neural hub.

16. The two-dimension configurable lighting system of claim 15 wherein the plurality of lighting elements for each neural hub are OLED panels.

17. A two-dimension configurable lighting system comprising a plurality of neural hubs, each of said neural hubs having three radiating neural arms separated by 120 degrees, the neural arms of any one of the neural hubs being connectable to any one of the neural arms of another of the neural hubs, such that a hex pattern lighting system can be propagated out from a single neural hub, said neural hubs being adapted to receive and retain a plurality of lighting elements thereon to provide a pattern of lighting elements which continues from one neural hub to another neural hub as the neural hubs are connected together to form a lighting system.

18. The two-dimension configurable lighting system of claim 17 further comprising at least one straight element connectable to any one of the neural arms of said neural hub, said straight element being adapted to receive and retain a plurality of lighting elements thereon to provide a pattern of lighting elements which continues from said straight element to the neural hub to which it is connected.

19. A neural hub for a two-dimension configurable lighting system comprising three connector rails, each of said connector rails having a curved midsection transitioning into straight terminal sections, the terminal straight sections of each connector rail having an angular relationship to each other of 120 degrees, said connector rails being interconnected such that the curved midsections of the rails form a center section of the neural hub and such that the straight terminal sections of adjacent connector rails radiate out from the center section in pairs that form neural arms of the neural hub, wherein the neural arms thusly formed radiate out from the center section of the neural hub with a separation between neural arms of 120 degrees, the straight terminal sections of the connector rails having connector ends wherein the connector ends of the pairs of straight sections that form the neural arms of the neural hub form connector ends of the neural arms, the connector ends of the neural arms being adapted to connect to the connector end of any neural arm of another neural hub or straight element of a lighting system comprised of at least two neural hubs or at least one neural hub and an end connectable straight element of the lighting system, said connector rails being adapted to connectably receive and retain a plurality of lighting element thereon in a pattern of lighting elements that extends through the center section of the neural hub into the neural arms of the neural hub.

20. The two-dimension configurable lighting system of claim 19 wherein said connector rails are adapted to connectably receive and retain a plurality of lighting elements anywhere along the length thereof.

21. The two-dimension configurable lighting system of claim 19 further comprising a center hanger bracket having a center core and spokes radiating out from the center core, each of said spokes supporting one of the connector rails of the neural hub.

22. The two-dimension configurable lighting system of claim 21 wherein said center hanger bracket provides a suspension point for a lighting system comprised of a plurality of the neural hubs.

23. The two-dimension configurable lighting system of claim 19 further comprising a bridge bracket connected between the adjacent straight terminal sections of each pair of the connector rail's straight termination sections that form the neural arms of the neural hub.

24. The two-dimension configurable lighting system of claim 19 wherein said connector rails provide wireways for wiring lighting elements retained on said connector rails.

25. A two-dimension configurable lighting system comprising at least one neural hub having a center section and neural arms radiating out from said center section, said neural arms having connector ends and said neural hub being adapted to connectably receive and retain a plurality of lighting elements in a pattern of lighting elements, and at least one straight element having connector ends which are connectable to any one of the connector ends of the neural arms of said neural hub, said straight elements being adapted to connectably receive and retain a plurality of lighting elements in a pattern wherein the pattern of lighting elements on said straight element continues the pattern of lighting elements on said neural hub.

26. The two-dimension configurable lighting system of claim 25 comprising a plurality of neural hubs and a plurality of straight elements, wherein said neural hubs and straight elements can be interconnected in an expanding pattern of neural hubs and straight elements to produce an expanding continuous pattern of lighting elements supported by said neural hubs and straight elements.

27. The two-dimension configurable lighting system of claim 26 wherein said neural hub has three neural arms radiating from said center section 120 degrees apart.

28. The two-dimension configurable lighting system of claim 26 wherein said plurality of neural hubs provide suspension points for suspending the lighting system from an overhead ceiling structure of a space.

* * * * *